US011389710B2

(12) United States Patent
Voloshin

(10) Patent No.: US 11,389,710 B2
(45) Date of Patent: Jul. 19, 2022

(54) SYSTEM FOR PITCHING SPORTS BALLS

(71) Applicant: Alexander Voloshin, Yokneam Illit (IL)

(72) Inventor: Alexander Voloshin, Yokneam Illit (IL)

( * ) Notice: Subject to any disclaimer, the term of this patent is extended or adjusted under 35 U.S.C. 154(b) by 162 days.

(21) Appl. No.: 16/799,972

(22) Filed: Feb. 25, 2020

(65) Prior Publication Data

US 2021/0260461 A1 Aug. 26, 2021

(51) Int. Cl.

| | |
|---|---|
| ***A63B 69/40*** | (2006.01) |
| ***A63B 47/02*** | (2006.01) |
| ***A63B 69/38*** | (2006.01) |

(52) U.S. Cl.

CPC ..... *A63B 69/406* (2013.01); *A63B 47/021* (2013.01); *A63B 69/38* (2013.01); *A63B 2225/50* (2013.01)

(58) Field of Classification Search

CPC ..... A63B 69/406; A63B 47/021; A63B 69/38; A63B 2225/50

See application file for complete search history.

(56) References Cited

U.S. PATENT DOCUMENTS

| | | | | |
|---|---|---|---|---|
| 5,832,909 | A * | 11/1998 | Grant | A63B 69/406 124/6 |
| 10,471,330 | B1 * | 11/2019 | Hart | A63B 69/406 |
| 2017/0095716 | A1 * | 4/2017 | Lewis | G09B 19/0038 |
| 2020/0269097 | A1 * | 8/2020 | Legg | A63B 47/021 |

* cited by examiner

*Primary Examiner* — Jeffrey S Vanderveen
(74) *Attorney, Agent, or Firm* — Mark M. Friedman

(57) ABSTRACT

A system for delivering balls to each of two players playing on opposite sides of a field includes a remote control unit worn or placed on each of the two players, each remote control unit configured, upon activation of a particular player, to transmit a wireless signal that identifies a location of the particular player. A ball pitching machine includes a housing configured to receive and hold the balls, at least one wheel, a ball shooting mechanism that receives the balls and shoots one of the balls at a time; and a controller that includes a position-locator, the controller configured to receive and process the signal, direct positioning of the ball shooting mechanism so as to face the player that sent the signal and shoot one of the balls in a direction of the player's position, in accordance with the signal received from the remote control unit.

24 Claims, 11 Drawing Sheets

SYSTEM FOR PITCHING SPORTS BALLS

FIELD OF THE INVENTION

The invention relates generally to sports apparatuses, and more particularly to ball pitching devices.

BACKGROUND OF THE INVENTION

Tennis is a popular sport, played by professionals and amateurs. The game is usually played by at least two players, but for practicing purposes, a player may play alone by throwing a ball against a wall, or by using a pitching machine which serves the ball to the player.

When playing a tennis game, much of the time and energy are spent on chasing balls and picking them up for re-use.

SUMMARY OF THE EMBODIMENTS

A method and apparatus for pitching tennis balls towards the players in certain embodiments saves a lot of time and energy for the players, and thereby makes the game more enjoyable.

Accordingly, certain embodiments overcome the limitations of prior art ball pitching machines, and provide an apparatus or system having a pitching machine for a match of two players, in which at the mere press of a button either player gets a ball thrown right to his or her hand or racquet.

Certain embodiments are designed for a tennis match between at least two players, although also a single player may benefit from it.

In accordance with certain embodiments, the apparatus or system is designed to reduce the time wasted waiting for new balls during a typical tennis match between two players, by providing a system of pitching balls. In some cases, the system also includes an automated ball collector that collects the tennis balls that have fallen on the tennis court, and that have been kicked or gathered to points adjacent the bottom of the net, into a pitching machine.

In accordance with one embodiment, the pitching machine pitches a ball in the direction of a player, and in some embodiments directly to that player's hand or racquet, by receiving a wireless signal from a remote control placed on the player and determining a position of the player wherever the player is located on or even off the court or field.

In certain embodiments, the pitching machine uses a ball shooting machine that can be aimed upwards and downwards, and the pitching machine can rotate sideways, so that a ball may be aimed and pitched anywhere. The apparatus or system is able to carry out the function of the ball boy utilized in professional tennis matches and even do so in a more efficient and faster manner.

In one aspect, there is provided a system for delivering balls to each of two players playing on opposite sides of a field, said system comprising a remote control unit worn or placed on each of the two players, each remote control unit configured, upon activation of a particular player, to transmit a wireless signal that identifies a location of the particular player; a ball pitching machine situated off the field, comprising: a housing, including at least one wheel, configured to receive and hold the balls, a ball shooting mechanism that receives the balls and shoots one of the balls at a time; and a controller comprising a position-locator, the controller configured to receive and process the signal, direct positioning of the ball shooting mechanism so as to face the player that sent the signal and shoot one of the balls in a direction of the player's position, in accordance with the signal received from the remote control unit.

In some embodiments, the ball pitching machine is situated adjacent a one end of a net that divides the field.

In some embodiments, the positioning of the ball pitching mechanism in accordance with a direction of the controller is accomplished by the controller directing rotation of a plate at a bottom of the ball pitching machine.

In some embodiments, the position locator is configured to determine a position of an outstretched hand of the player who activated the remote control such that the player who activated can conveniently catch a ball shot by the ball pitching machine.

In some embodiments, the controller is configured to instruct the ball shooting mechanism to shoot the ball at a distance and an angle so as to be conveniently catchable by an outstretched (i) hand or (ii) racquet of the player.

In some embodiments, the controller is configured to direct the ball shooting mechanism to shoot the one of the balls in the direction of the player's position within one second.

In some embodiments, the ball pitching mechanism is configured to pitch balls to either player on any part of the field.

In some embodiments, the ball pitching mechanism is configured to pitch balls to either player on any part of the field other than within a predefined distance from a net that divides the field.

In some embodiments, the ball shooting mechanism includes two rotatable wheels situated such that balls coming from the ball feeder are urged to contact each of the two rotatable wheels so as to be thrust between the two rotatable wheels and shot out of the ball pitching machine.

In some embodiments, the ball shooting mechanism includes two rotatable wheels attached to a fixture rotatable to change an angle at which the ball shooting mechanism ejects balls.

In some embodiments, the ball shooting mechanism is configured to receive the balls from a ball feeder.

In some embodiments, the system further comprises an apparatus for collecting the balls, the apparatus comprising a ball-adhering ribbon surrounding a perimeter of a bottom of a net on the field; a scooper attached to the ball-adhering ribbon and configured to advance relative to the ribbon and thereby collect balls that have adhered to said ribbon and urged the collected balls into the ball pitching machine for re-use, so that the players do not need to chase after the balls used during the game, thereby enhancing the game experience. In some embodiments, the scooper is configured to direct collected balls to a bottom of the ball pitching machine and wherein the ball feeder is configured to receive balls from the bottom of the ball pitching machine. In some embodiments, the ball pitching machine is situated adjacent one end of the track.

In another aspect, there is provided a system for delivering balls to each of two players playing on opposite sides of a field, said system comprising a remote control configured to be placed on each of the two players and configured to send a wireless signal that identifies a location of a particular player of the two players that sent the signal; a ball pitching machine comprising: a housing configured to receive and hold the balls, a ball feeder, a ball shooting mechanism that receives the balls, one at a time, from the ball feeder and is configured to shoot one of the balls at a time; and a rotatable barrel in communication with the housing and oriented at an angle to the housing, the barrel having an ejection component that cooperates with the shooting mechanism; a controller comprising a position-locator, the controller configured to receive and process the signal, direct rotation of said rotatable barrel such that the ejection component faces the player that sent the signal and shoot one of the balls in a direction of the player's position, in accordance with the signal received from said remote control unit.

In some embodiments, the ball shooting mechanism is inside the rotatable barrel.

In some embodiments, the ball shooting mechanism includes two rotatable wheels situated such that balls coming from the ball feeder are urged to simultaneously contact each of the two rotatable wheels and be thrust between the two rotatable wheels.

In some embodiments, the controller is configured to instruct the ball shooting mechanism to shoot the ball at a distance configured to be catchable by an outstretched hand of the player.

In some embodiments, the ejection component juts out of the housing and wherein a remainder of the barrel is within the housing.

In some embodiments, the rotatable barrel is oriented at an angle to a side of the housing.

In some embodiments, the ball feeder is configured to receive balls that were collected on the field and urged into the ball pitching machine. In some embodiments, the system further comprises an apparatus for collecting the balls, the apparatus comprising: a ball-adhering ribbon surrounding a perimeter of a bottom of a net on the field; a scooper attached to the ball-adhering ribbon and configured to advance relative to the ribbon and thereby collect balls that have adhered to said ribbon and urged the collected balls into the ball pitching machine for re-use, so that the players do not need to chase after the balls used during the game, thereby enhancing the game experience. In some embodiments, the scooper is configured to direct collected balls to a bottom of the ball pitching machine and wherein the ball feeder is configured to receive balls from the bottom of the ball pitching machine. In some embodiments, the ball pitching machine is situated adjacent one end of the track.

These and other features, aspects and advantages will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE EMBODIMENTS

The embodiments generally provide a system for pitching balls, such as tennis balls, to at least two players playing a match such as a tennis match, by locating their exact position on the court, and pitching a ball in their direction in response to receiving a remotely activated signal. A ball pitching machine is positioned in an area adjacent to the field but off the field, for example adjacent one end of the net that divides the field for the two players (for example a tennis court net). Each player may wear a remote control unit with an activation button or actuator signaling a controller in the ball pitching machine to shoot a ball out of the machine to that player. The controller is configured in some embodiments to calculate how far to shoot the ball and in what direction so that the player can conveniently stretch out their hand and catch the ball. Regardless of where the player is on the field they can have a ball thrown to them by pushing a button. Each player will have a ball thrown to them in some embodiments within a fraction of a second from having pushed a conveniently located button easily accessed. The flow of the game is maintained that way since each player has a remote control device. Alternatively a smart camera determines the players' locations.

Some embodiments also have a ball collection apparatus that collects balls used during the game and sends them to the ball pitching machine.

The principles and operation of a System for Pitching Sports Balls may be better understood with reference to the drawings and the accompanying description.

Figure 1:
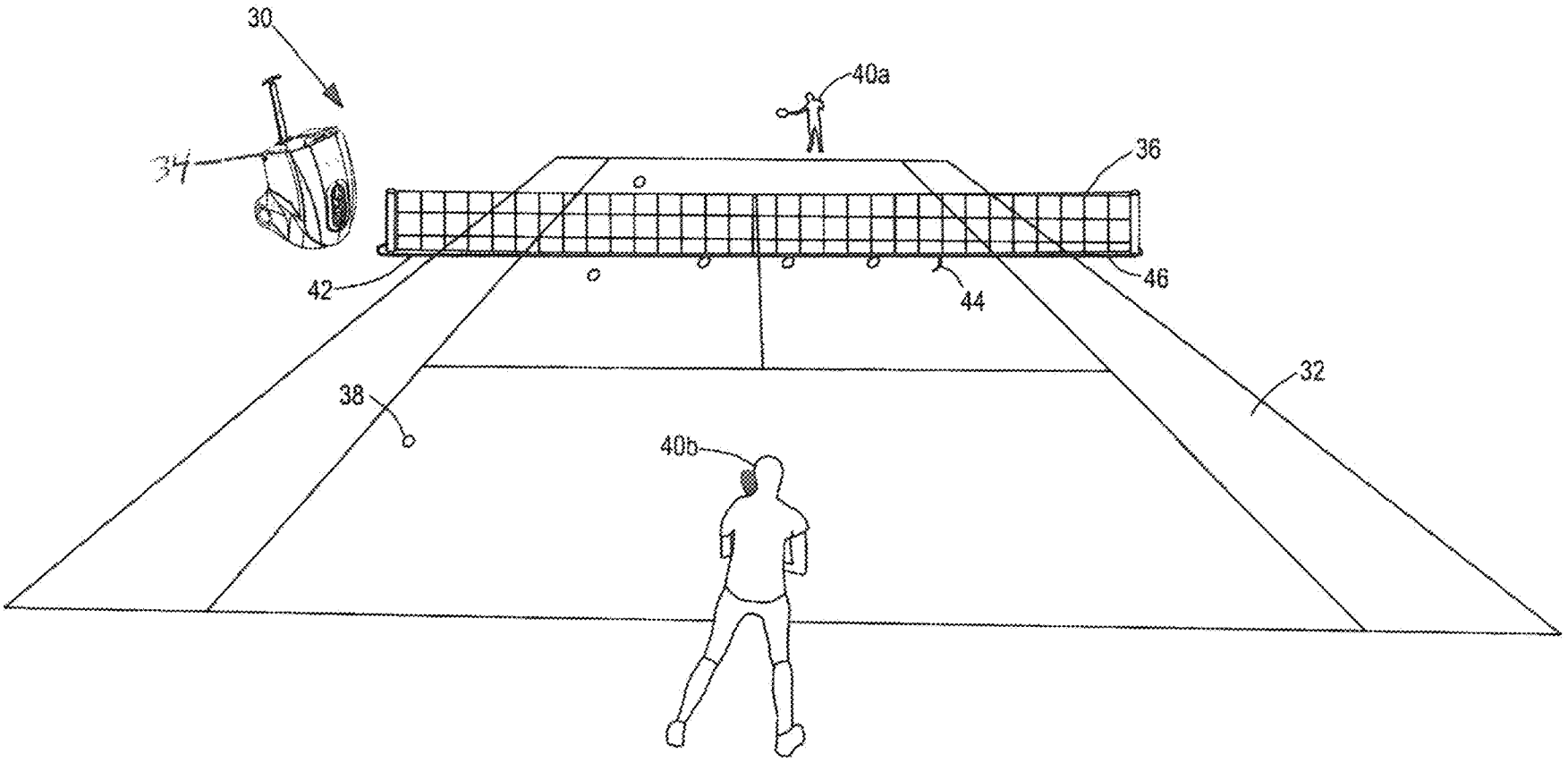
FIG. 1 shows a perspective view of a system for pitching balls, in accordance with one embodiment.

A system 10 for delivering balls 38 to each of two players 40*a*, 40*b* playing on opposite sides of a field is shown in FIG. 1. In certain embodiments, system 10 includes a communications device 48 such as a remote control unit 48 suitable to be worn or placed on each of the players. Each remote control unit 49 may be configured, upon activation of a particular player, to transmit a wireless signal that identifies a location of that particular player on the court or field (or in some embodiments even their position at points beyond the boundary of the tennis court or the field). In some embodiments, communications device 48 comprises a small camera instead of a remote control device, for example an infra red camera, that determines the position of the player. Communications device 48 may use any technology for transmitting the position of the player who thereby signals that the player wants a ball thrown to him or her.

As shown in FIGS. 3-6B, system 10 also includes a ball pitching machine 34 that may have a housing 51 and at least one wheel 58 so that ball pitching machine can be moved when not in use. Machine 34 also includes a motor 53 (and gears) that may be attached to plate 59 and that is configured to generate rotation of plate 59 situated at the bottom of ball pitching machine 34 so that the entire ball pitching machine (other than plate 59) can be rotated (in some embodiments 360°) so as to aim ball pitching machine 34 and in particular ball shooting mechanism 35 of ball pitching machine 34 toward the player (in any place on the field that the player is located at) that activated their remote control unit 48 and who wishes to receive a ball 38. Ball pitching machine 34 may also include a motor connected by electronics or other infrastructure to the at least one wheel 58. In one embodiment shown in FIG. 6A, housing 51 sits on plate 59 and the at least one wheel 58 comprises two wheels 58 situated adjacent each of the two rear side corners of plate 59. The two wheels 58 are configured so that if one tilts ball pitching machine 34 to an angle from the plane of plate 59, one can move the entire ball pitching machine 34 on its wheels 58 to set machine 34 in place for use or to otherwise move the machine for any purpose.

Accordingly, ball pitching machine 34 is configured to turn left or right toward either player and toward any portion of the court/field that the player is located in. Ball pitching machine 34, in one embodiment, can rotate 360°. In such an embodiment, ball pitching machine 34 is configured to accommodate players who are even off the field/court for example to pick up a ball, and ball pitching machine 34 is configured as well to be used to serve balls to two adjacent courts for example by being placed between the two courts, for example in an area parallel to or aligned with or adjacent to the nets of the two courts. Housing 51 is configured to receive and hold the balls 38.

Figure 6A:
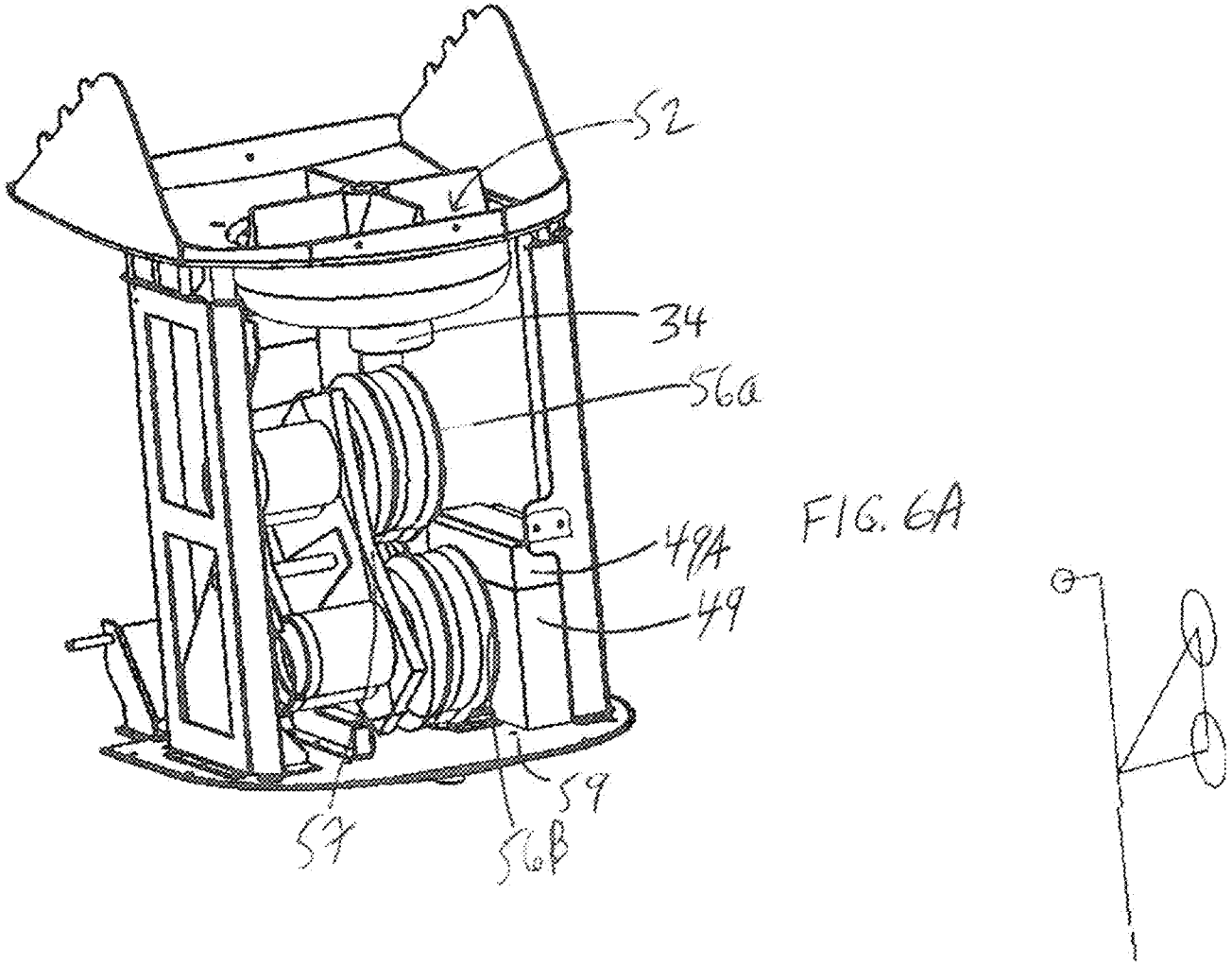
FIG. 6A shows the inside of a ball pitching machine from a top and side perspective, in accordance with one embodiment.
Figure 6B:
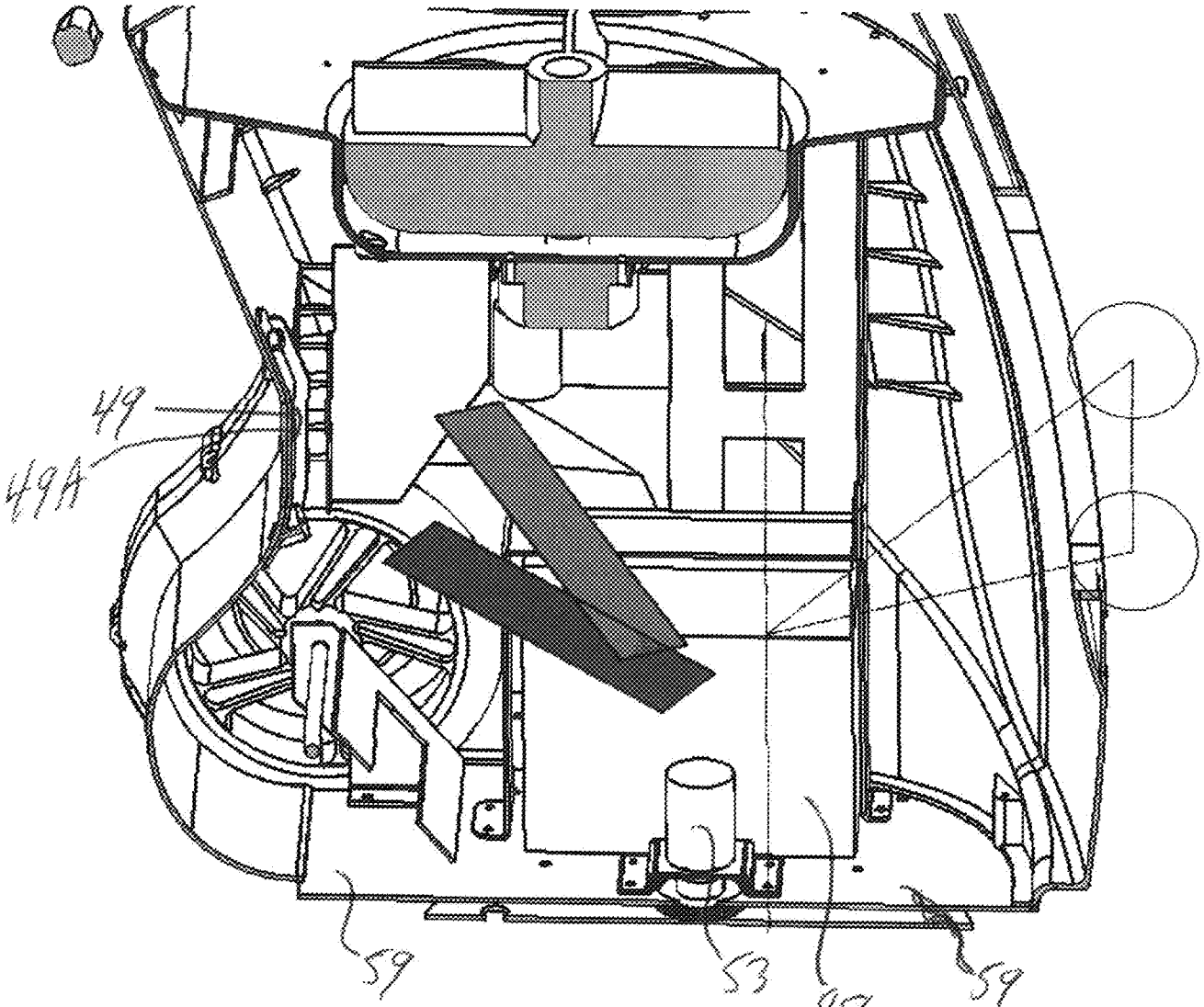
FIG. 6B shows the inside of a ball pitching machine from a side perspective, in accordance with one embodiment.

System 10 may also comprise a ball shooting mechanism 35 that receives the balls 38 (for example from ball feeder 54) and shoots one of the balls 38 out of ball pitching machine 34 at a time toward the player through an opening 37. System 10 may also include a controller 49. In one implementation, controller 49 is part of ball pitching machine 34 and may be situated within housing 51. Alternatively, controller 49 may be external to ball pitching machine 34 and may operate wirelessly to send instructions to electronics situated within or on ball pitching machine 34. The positioning of controller 49 in FIG. 6B is only exemplary and controller 49 can be situated in any of a variety of portions of system 10.

Controller 49 (FIG. 6B) may comprise hardware and software including a position-locator module 49A for locating a position of the player that activated that player's remote control unit 48 and wants a ball. Position-locator module 49A may employ any suitable technology including but not limited to infra red technology, Bluetooth® technology, acoustic sensor technology or any other suitable technology. Position-locator module 49A may also be in communication with a positioning system in cooperation with the remote unit 48 (or independent of remote unit 48). Controller 49 and position locator module 49A include any communications hardware and software necessary to communicate with remote control unit 48 and any positioning system configured to determine the position of players 40*a*, 40*b*.

Controller 49 is configured to receive and process the signal sent by remote 48 and direct positioning of the ball pitching machine 34 such that the ball shooting mechanism 35 faces the player that sent the signal and shoot one of the balls 38 in a direction of that player's position, in accordance with the signal received from the remote control unit 48.

In certain embodiments, the positioning of the ball pitching machine 34 for aiming toward the player by controller 49 is accomplished by controller 49 directing motor 53 to generate rotation of plate 59. The ball shooting mechanism 35 of ball pitching machine 34 is also directed to be positioned at the suitable angle to plate 59 or to the floor(that machine 34 or housing 51 is on) for reaching the player.

In one embodiment, the position locator module 49A is configured to determine a position of a player who sent the signal from anywhere on the court. For example, in one embodiment, the position locator module 49A is configured to determine a position of an outstretched hand or racquet of the player who activated the remote control such that the player who activated can conveniently catch a ball shot by the ball pitching machine. Alternatively, the position locator module 49A is configured to determine a location of the player's remote 48 and controller 49 is configured to use that information to calculate the location of where the player's outstretched hand or racquet would be if that player stretched it (the hand or racquet) to catch a ball thrown to him.

In one embodiment, the position locator module 49A is configured to determine a position of a player who sent the signal from anywhere on the court even before the player sends the wireless signal by keeping tabs on the player's position using a positioning system that is in communication with the player's remote control unit 48.

In one embodiment, instead of a remote control unit 48, a smart camera is positioning overlooking the entire court and determines each player's position, for example in real time.

In general, controller 49 is configured to instruct the ball shooting mechanism 35 to shoot the ball 38 at a distance and an angle so as to be conveniently catchable by an outstretched hand of the player. For example, controller 49 may instruct a motor to turn rotatable wheels 56*a*, 56*b* and to actuate ball feeder 54. In some embodiments, controller 49 is configured to direct the ball shooting mechanism 35 to shoot the one of the balls in the direction of the player's position within one second, or in other embodiments within half a second, or in some embodiments within a fraction of a section or in other embodiments, within 1.5 seconds or within 2 seconds, or within some other suitable interlude from when the remote 48 is activated by a player.

Ball pitching machine 34 is configured to pitch balls 38 to either player on any part of the field. Ball pitching machine 34 is configured to pitch balls to either player on any part of the field other than within a predefined distance from a net that divides the field.

Ball shooting mechanism 35 may include two rotatable wheels 56*a*, 56*b* and may include a motor 56*c*, 56*d* (FIG. 5) for each of them to generate their rotation. Rotatable wheels 56*a*, 56*b* may be situated such that balls 38 coming from ball feeder 54 are urged to contact each of the two rotatable wheels 56*a*, 56*b* (for example simultaneously) so as to be thrust between the two rotatable wheels 56*a*, 56*b* and shoot out of ball pitching machine 34. In some embodiments, rotatable wheels 56*a*, 56*b* may be attached to a fixture 57 (FIG. 6A) that is rotatable to change an angle at which the ball shooting mechanism 35 ejects balls 38 for example by changing an angle that the substantially linear path of balls travelling between rotatable wheels 56*a*, 56*b* makes with plate 59 and/or by changing an angle that rotatable wheels 56*a*, 6*b* are positioned at relative to plate 59. The combination of the ability to rotate the entire ball pitching machine 34 by rotating plate 59 and the ability to rotate wheels 56*a*, 56*b* allows for a ball 38 to be pitched to any location on tennis court 32 (shown in FIG. 1), and to any height, according to the height of player 40, or the player's outstretched racquet or hand.

In some embodiments of ball pitching machine, there are as many as five motors, including one motor to operate ball feeder 35, one motor 53 that rotates plate 59, two motors that rotate rotatable wheels 56*a*, 56*b* of ball shooting mechanism 35 (one motor for each wheel 56*a*, 56*b*) and that one that rotates the fixture 57 that rotatable wheels 56*a*, 56*b* are affixed to in order to set the proper angle.

FIG. 1 shows a perspective view of the system for pitching balls 30, on a tennis court 32. A pitching machine 34 is positioned adjacent one end of net 36, so that pitching machine 34 may aim a ball 38 to either player 40*a* or player 40*b*. The net 36 is deemed to be in a middle portion of the field and divides the field into two parts one for one player and a second part for the second player. The area where the net is situated may be referred to loosely as the middle portion of the field or court 32. In one implementation, pitching machine 34 may be situated adjacent a middle portion of the field such that it is either adjacent one end of the net 36. In another implementation, pitching machine 34 is situated on a side of the field or court 32 in an area off the actual field or court 32. Although FIG. 1 shows an embodiment that includes a collecting ball apparatus 42, this is not a requirement.

Figure 2:
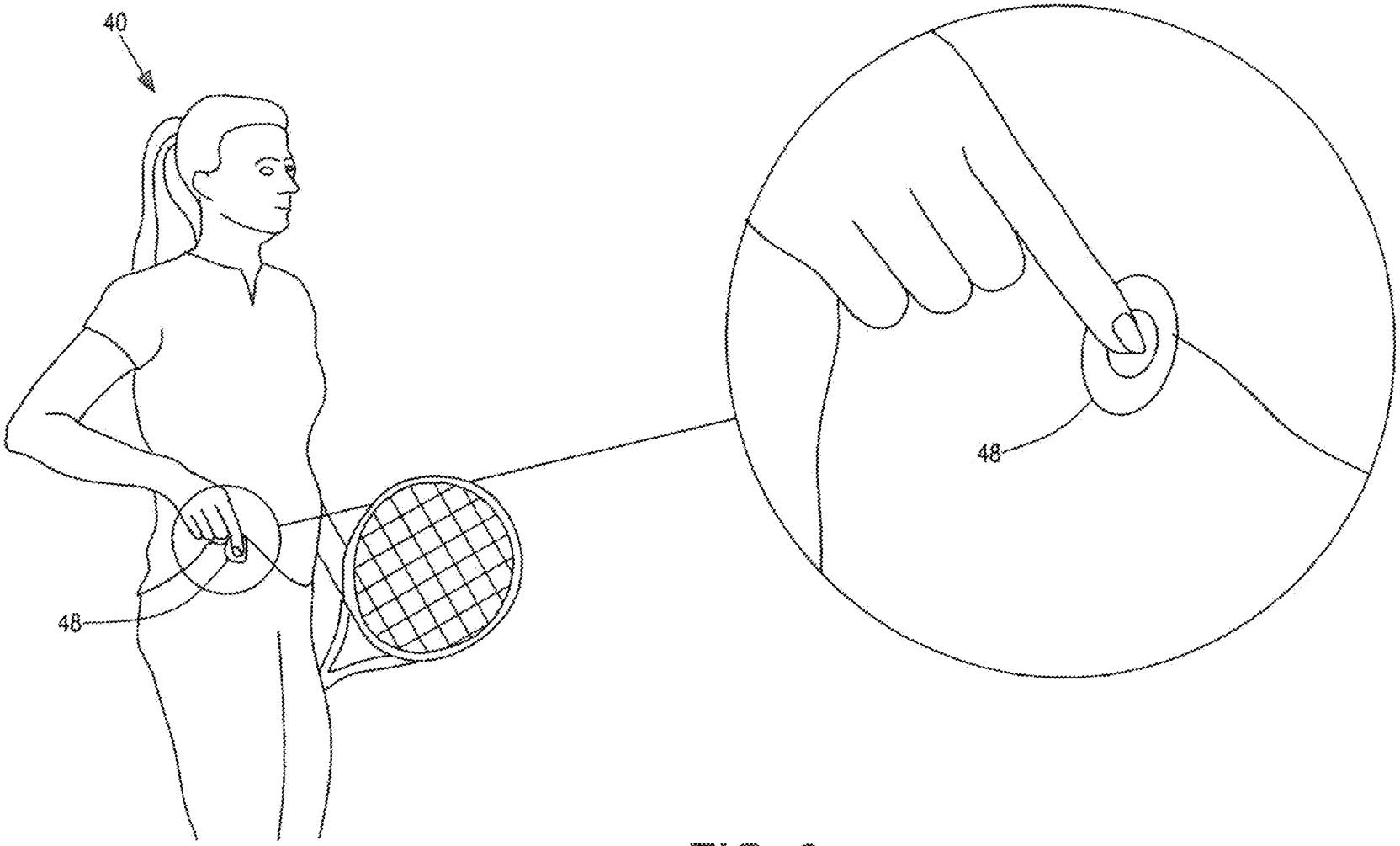
FIG. 2 shows a remote control attached to a tennis player, in accordance with one embodiment.
Figure 3:
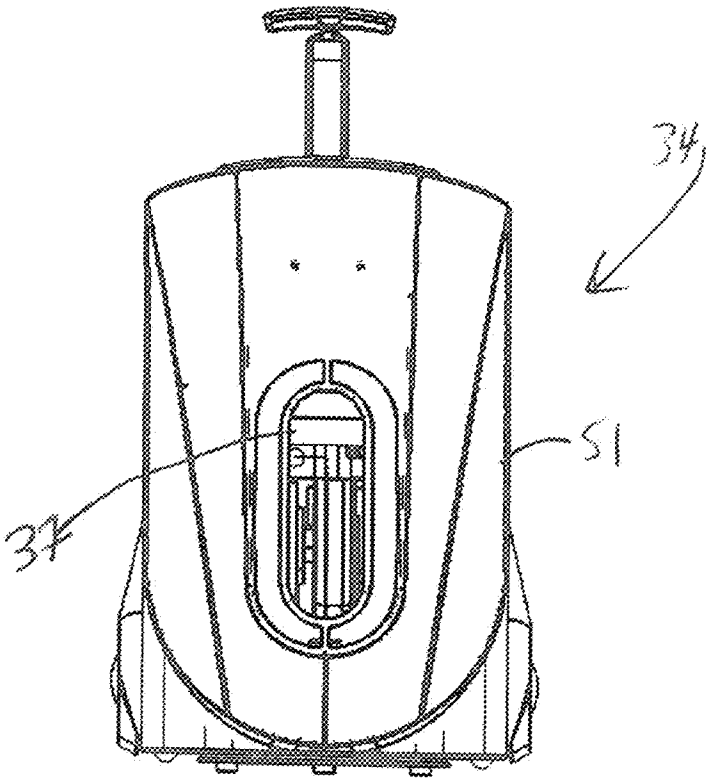
FIG. 3 shows a front view of ball pitching machine, in accordance with one embodiment.
Figure 4:
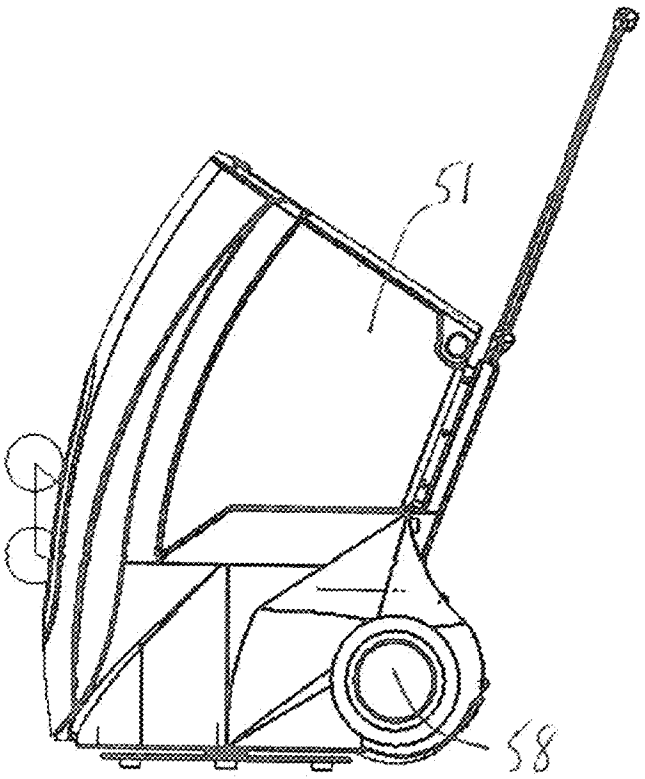
FIG. 4 shows a side view of ball pitching machine, in accordance with one embodiment.
Figure 5:
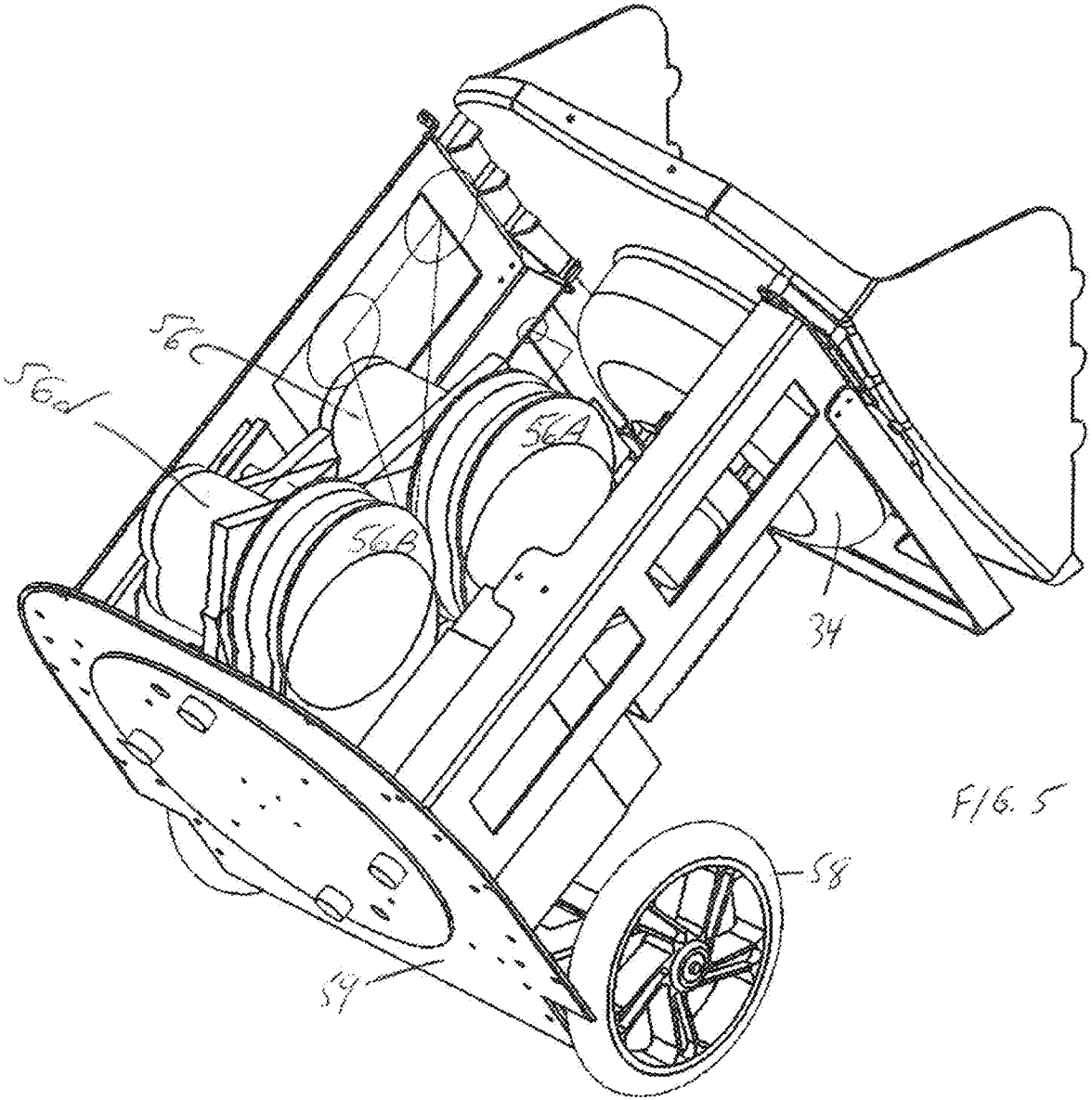
FIG. 5 shows the inside of a ball pitching machine from a bottom and side perspective, in accordance with one embodiment.

As shown in FIG. 2, there is shown tennis player 40 with a remote control unit 48. By operating remote control unit 48, pitching machine 34 receives a wireless signal to pitch a ball 38 towards player 40. Pitching machine 34 receives a wireless signal as to the exact location of the remote control unit 48, and therefore, as to the exact location of the player 40*a*, 40*b*. The ball 38 is pitched into the hands of player 40, thereby player 40 does not need to bend and pick up ball 38 from the ground.

Remote control unit 48 may comprise any simple device that can be worn on clothing or in some embodiments on a wrist or other body part. Remote control unit 48 may operate using infra red technology, Bluetooth® technology, acoustic sensor technology or any other suitable technology or communication system and includes all necessary hardware and software. The player 40 pushes an actuator such as a button on remote control unit 48 to send the signal received by controller 49 of pitching machine 34.

Figure 7:
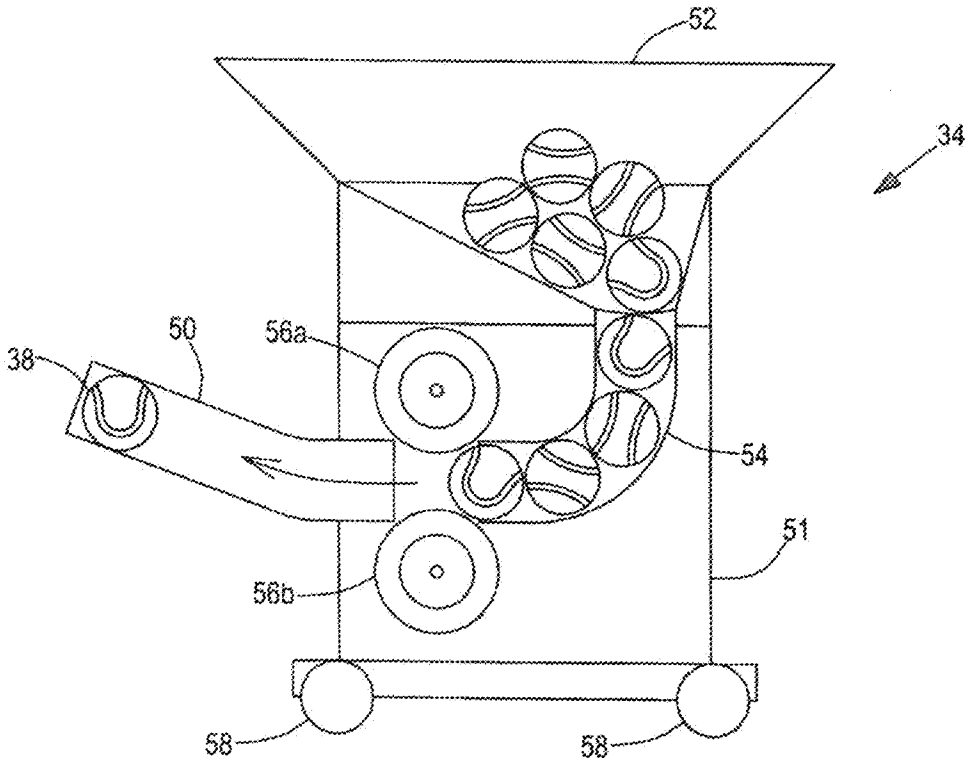
FIG. 7 shows a schematic view of a ball feeder mechanism of a pitching machine, in accordance with one embodiment.

FIG. 7 depicts a different implementation of ball pitching machine 34 (or parts thereof) showing one particular implementation in which a ball feeder 54 places one ball at a time between rotatable wheels 56*a*, 56*b* at a time when wheels 56*a*, 56*b* rotate rapidly. However, the ball feeder 54 or any other suitable ball feeder 54 may be used in the embodiments of pitching machine 34 shown in FIGS. 1, 3-6B. In FIG. 7, rotatable barrel 50 is oriented at an angle to a wall of housing 51 (perpendicular to the floor), through which balls 38 are pitched towards player 40. In this embodiment, when pitching machine 34 receives a wireless signal from remote control unit 48 (shown in FIG. 2), a controller 49 processes the signal and barrel 50 rotates in the direction of the origin of the signal and then shoots ball 38 towards player 40 holding remote control unit 48.

Figure 8:
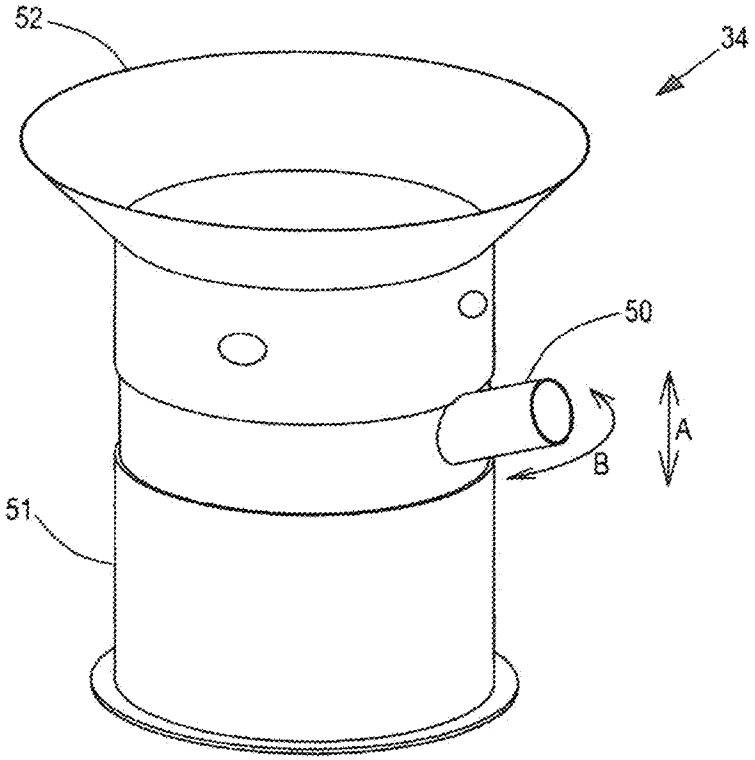
FIG. 8 shows a barrel of the pitching machine of FIG. 3, in accordance with one embodiment.

In the embodiment of FIGS. 1 and 3-6B and in the embodiment of FIGS. 7-8, a top of pitching machine 34 may have an opening 52, shaped as a collection hopper for receiving and holding balls in pitching machine 34. Opening 52 may lead to ball feeder 54 which leads balls 38 to ball shooting mechanism 35. Ball shooting mechanism 35 receives the balls 38, one at a time, from the ball feeder 54 and is configured to shoot one of the balls at a time. In some embodiments, the ball shooting mechanism 35 has rotatable wheels 56*a*, 56*b* situated such that balls 38 coming from the ball feeder 54 are urged to simultaneously contact each of the two rotatable wheels 56*a*, 56*b* and be thrust between them. Since rotatable wheels 56*a*, 56*b* are rotating rapidly, they generate a strong force on the ball 38 to thrust ball 38 out from the space between the two rotatable wheels 56*a*, 56*b* and out of opening 37 in housing 51 of ball pitching machine 34. In the embodiment of FIG. 7, ball shooting mechanism 35 thereby shoots ball 38 through an ejection component 50 of ball pitching machine 34 and into the hands of player 40.

Pitching machine 34 may be powered by a chargeable battery 88 (FIG. 6B) or an electrical connection (not shown).

FIG. 8 shows a further embodiment of pitching machine 34, showing that ejection component 50 can move up and down and also rotate sideways, illustrated by arrows A and B, respectively. This ability allows for ball 38 to be pitched to any location on tennis court 32 (shown in FIG. 1), and to any height, according to the height of player 40.

Figure 9:
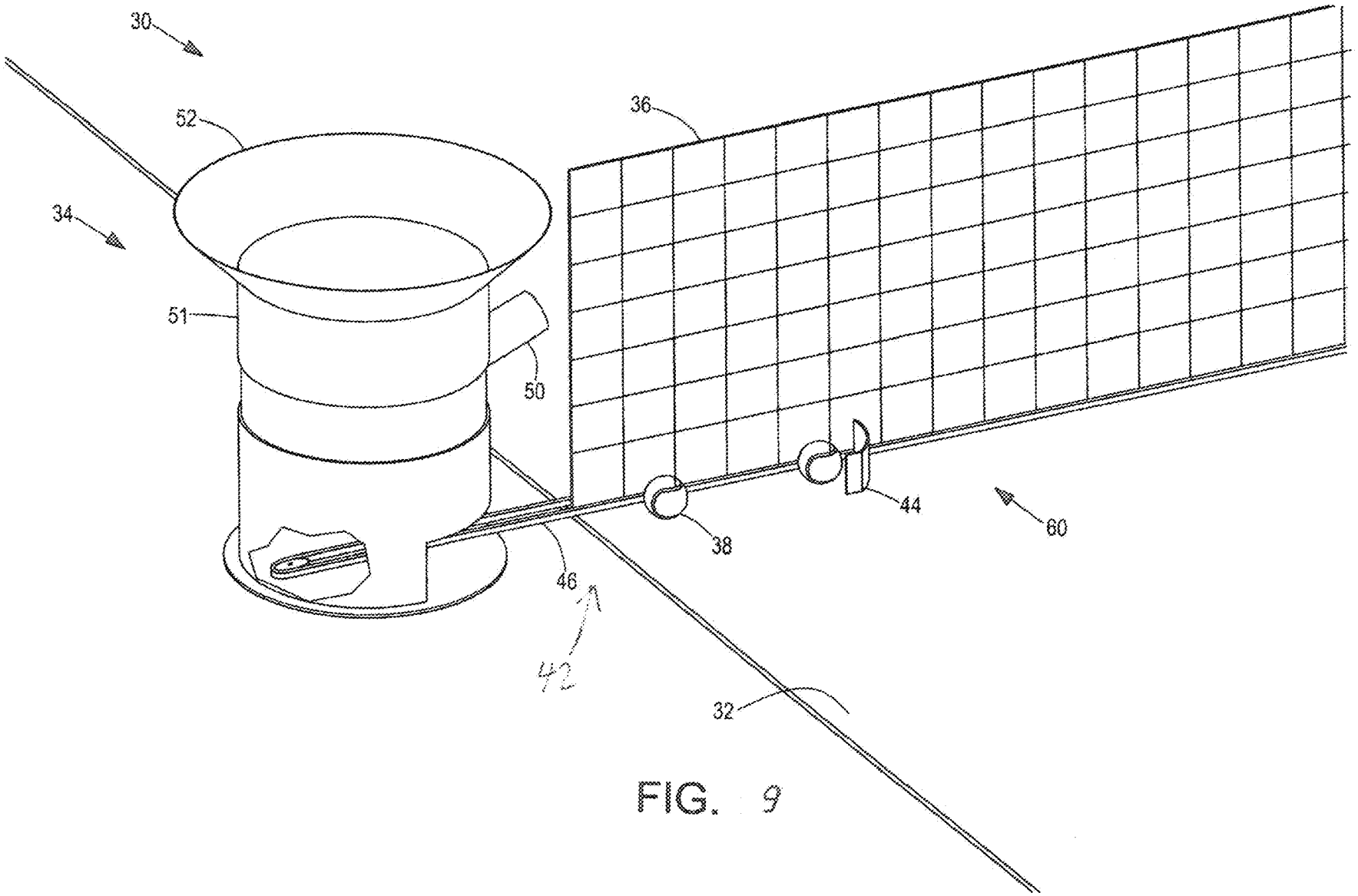
FIG. 9 shows the system of FIG. 1, illustrating the ball collecting apparatus of the system of FIG. 1, in motion, in accordance with one embodiment.

Referring now to FIG. 9, there is shown an apparatus 42 for collecting balls 38. Ball pitching machine 34 is positioned in proximity to a tennis net 36 on court 32. FIG. 1 shows an embodiment that includes a collecting ball apparatus 42 connected to the bottom of net 36, so that scooper 44 collects balls 38 which become attached to ribbon 46.

Ball collecting apparatus 42 includes ribbon 46 (or track) surrounding the base of net 36, looped at one end around the bottom edge of net 36, with the other end entering the bottom of pitching machine 34. Ribbon 46 is made of any material that can adhere to tennis balls, such as Velcro™, or material that will stop balls 38 from rolling away from it. When ball 38 bounces away from player 40 and stops somewhere on court 32, player 40 may kick ball 38 towards net 36 so that it stops close to ribbon 46. Multiple balls 38 may remain near net 36, before their collection.

Ball collecting apparatus 42 is operated by a wireless signal received from pitching machine 34 or remote control unit 48. Scooper 44 advances along ribbon 46, thereby collecting balls 38 that are attached to or close to one side of the bottom edge of net 36. Scooper 44 eventually advances to the inside of pitching machine 34, and there balls 38 are advanced further into ball pitching machine 34 and scooper 44 continues along the opposite side of the bottom edge of net 36 to collect balls 38 that have accumulated there. Scooper 44 can complete a full circle and then stop either automatically or by a wireless signal received from pitching machine 34 or remote control 48. There is a possibility that there are two scoopers 44 spaced apart from each other, one on each end of ribbon 46 so that both opposite sides of the bottom edge of net 36 are simultaneously cleared of balls 38, in only half a cycle. Ball collecting apparatus 42 may be preset to operate periodically over an interval, or may be operated by pressing a button on remote control 48.

Ball container may contain approximately up to forty balls 38, so that when it fills up, the container can be taken out of pitching machine 34 and balls 38 can be poured into the collection hopper at opening 52, thereby allowing balls 38 to be re-used by pitching machine 34 for pitching to player 40.

Balls 38 in the container may be transferred automatically (as opposed to manually, as described above) to collection hopper at opening 52 and from there balls 38 ascend into tube 54.

Figure 10:
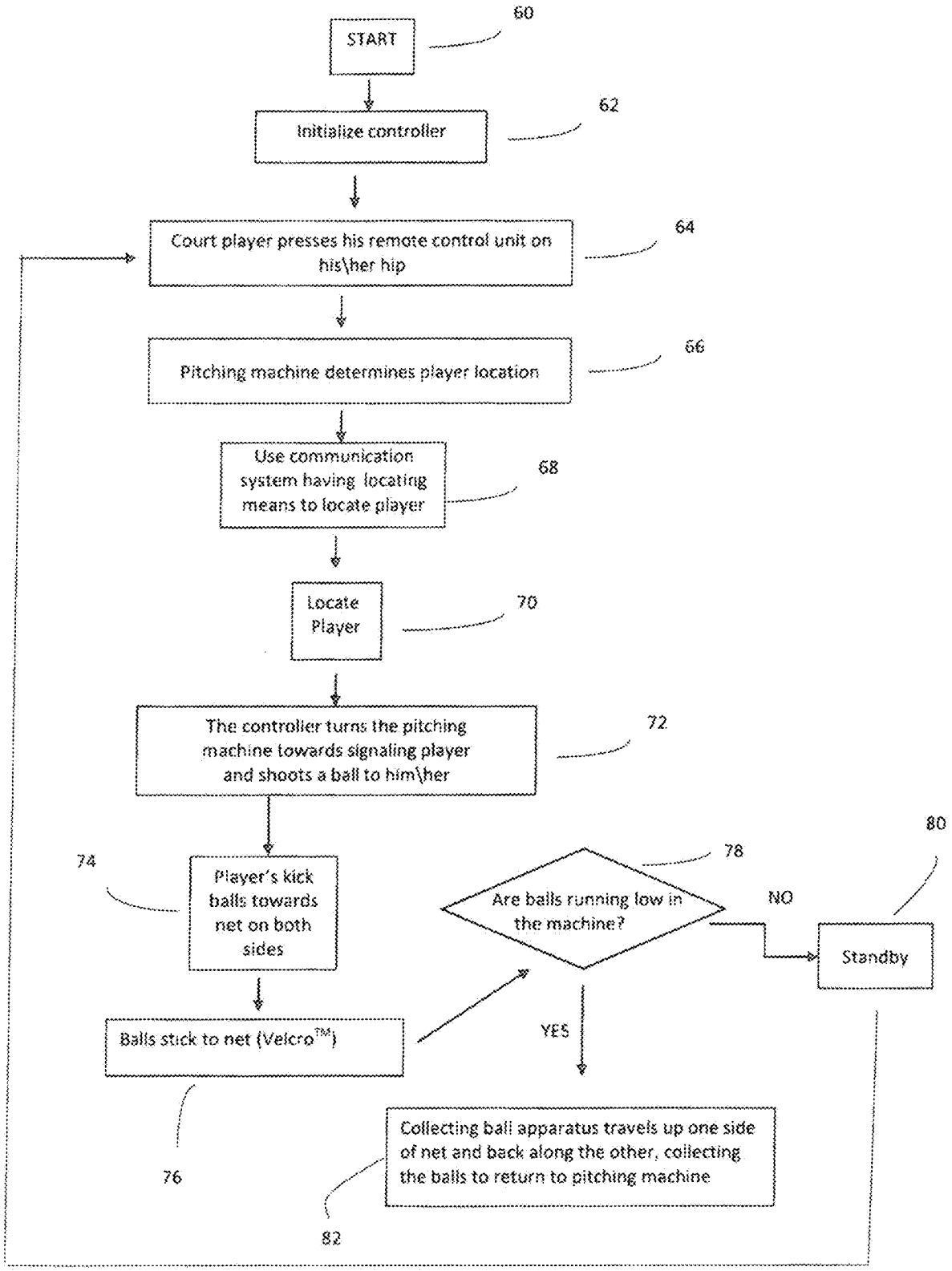
FIG. 10 shows a flowchart of a system, in accordance with one embodiment.

Referring now to FIG. 10, there is shown a flowchart of the operation of the system for pitching and collecting balls 30.

At block 60 the operation begins and the controller 49 is initialized in block 62. At block 64 a player 40, having a remote control unit 48, initiates the tennis match by pressing a button on remote control unit 48, generating a wireless signal transferred by a communicating system to controller 49. At blocks 66, 68 and 70, the pitching machine 34 uses the communication system to determine the player 40 location by interpreting the signal received by controller 49. At block 72 the controller 49 aims the pitching machine 34 at player 40 and shoots a ball 38 to him/her. At block 74 the players 40, on either side of the net 36, kick balls 38 that have landed on the tennis court, towards net 36, so that these balls 38 either adhere to the net as a result of coming into contact with ribbon 46 having a Velcro™ lining (block 76), or the balls remain in close proximity to net 36.

At block 78, players 40 observe the quantity of balls 38 that have been expended from the pitching machine 34, if the number of balls 38 are running low in the pitching machine 34, then player 40 initiates at block 82, operation of the collecting ball apparatus 42. A scooper 44 is operated by a wireless signal received from remote control unit 48, and advances along ribbon 46 while collecting balls 38 that are in close proximity to, or adhered to it. Scooper 44 collects balls 38 into pitching machine 34, so that they can be re-used.

In an alternative embodiment of the present invention, block 82 may be initiated automatically by presetting collecting ball apparatus 42 to operate periodically over an interval.

If the number of balls are not running low, then collecting ball apparatus 42 is on standby (block 80).

The inventive system for pitching and collecting balls 30, according to the preferred embodiments of the present invention, can be used on any standard tennis nets on a tennis court.

Although particular embodiments of the invention have been described and illustrated herein, it is recognized that modifications and variations may readily occur to those skilled in the art and consequently, it is intended that the claims be interpreted to cover such modifications and equivalents. Therefore, the claimed invention as recited in the claims that follow is not limited to the embodiments described herein.

What is claimed is:

1. A system for delivering balls to each of two players playing on opposite sides of a field, said system comprising:
- a remote control unit worn or placed on each of the two players, each remote control unit configured, upon activation of a particular player, to transmit a wireless signal that identifies a location of the particular player;
- a ball pitching machine situated off the field, comprising:
  - a housing, including at least one wheel, configured to receive and hold the balls,
  - a ball shooting mechanism that receives the balls and shoots one of the balls at a time; and
  - a controller comprising a position-locator, the controller configured to receive and process the signal, direct positioning of the ball shooting mechanism so as to face the player that sent the signal and shoot one of the balls in a direction of the player's position, in accordance with the signal received from the remote control unit,
  - wherein the position locator is configured to determine a position of a hand of the player who activated the remote control such that the player who activated can conveniently catch a ball shot by the ball pitching machine.

2. The system of claim 1, wherein the ball pitching machine is situated adjacent a one end of a net that divides the field.

3. The system of claim 1, wherein the positioning of the ball pitching mechanism in accordance with a direction of the controller is accomplished by the controller directing rotation of a plate at a bottom of the ball pitching machine.

4. The system of claim 1, further comprising a ball feeder and wherein the ball shooting mechanism includes one rotatable wheel that is positioned below an exit opening of the ball feeder and that is configured to contact, one at a time, the balls that exit the exit opening.

5. The system of claim 1, wherein the controller is configured to instruct the ball shooting mechanism to shoot the ball at a distance and an angle so as to be conveniently catchable by an outstretched (i) hand or (ii) racquet of the player.

6. The system of claim 1, wherein the controller is configured to direct the ball shooting mechanism to shoot the one of the balls in the direction of the player's position within one second.

7. The system of claim 1, wherein the ball pitching mechanism is configured to pitch balls to either player on any part of the field.

8. The system of claim 1, wherein the ball pitching mechanism is configured to pitch balls to either player on any part of the field other than within a predefined distance from a net that divides the field.

9. The system of claim 1, wherein the ball shooting mechanism includes two rotatable wheels situated such that balls coming from the ball feeder are urged to contact each of the two rotatable wheels so as to be thrust between the two rotatable wheels and shot out of the ball pitching machine.

10. The system of claim 1, wherein the ball shooting mechanism includes two rotatable wheels attached to a fixture rotatable to change an angle at which the ball shooting mechanism ejects balls.

11. The system of claim 1, wherein the ball shooting mechanism is configured to receive the balls from a ball feeder.

12. The system of claim 1, further comprising an apparatus for collecting the balls, the apparatus comprising:
- a ball-adhering ribbon surrounding a perimeter of a bottom of a net on the field;
- a scooper attached to the ball-adhering ribbon and configured to advance relative to the ribbon and thereby collect balls that have adhered to said ribbon and urged the collected balls into the ball pitching machine for re-use, so that the players do not need to chase after the balls used during the game, thereby enhancing the game experience.

13. The system of claim 12, wherein the scooper is configured to direct collected balls to a bottom of the ball pitching machine and wherein the ball feeder is configured to receive balls from the bottom of the ball pitching machine.

14. The system of claim 12, wherein the ball pitching machine is situated adjacent one end of the track.

15. The system of claim 1, wherein the position locator is configured to determine the position of the outstretched hand of the player who activated the remote control.

16. A system for delivering balls to each of two players playing on opposite sides of a field, said system comprising:
- a remote control configured to be placed on each of the two players and configured to send a wireless signal that identifies a location of a particular player of the two players that sent the signal;
- a ball pitching machine comprising:
  - a housing configured to receive and hold the balls,
  - a ball feeder,
  - a ball shooting mechanism that receives the balls, one at a time, from the ball feeder and is configured to shoot one of the balls at a time; and a rotatable barrel in communication with the housing and oriented at an angle to the housing, the barrel having an ejection component that cooperates with the shooting mechanism;

a controller comprising a position-locator, the controller configured to receive and process the signal, direct rotation of said rotatable barrel such that the ejection component faces the player that sent the signal and shoot one of the balls in a direction of the player's position, in accordance with the signal received from said remote control unit, further comprising an apparatus for collecting the balls, the apparatus comprising:

a ball-adhering ribbon surrounding a perimeter of a bottom of a net on the field;

a scooper attached to the ball-adhering ribbon and configured to advance relative to the ribbon and thereby collect balls that have adhered to said ribbon and urged the collected balls into the ball pitching machine for re-use so that the players do not need to chase after the balls used during the game, thereby enhancing the game experience.

17. The system of claim 16, wherein the ball shooting mechanism is inside the rotatable barrel.

18. The system of claim 16, wherein the ball shooting mechanism includes two rotatable wheels situated such that balls coming from the ball feeder are urged to simultaneously contact each of the two rotatable wheels and be thrust between the two rotatable wheels.

19. The system of claim 16, wherein the controller is configured to instruct the ball shooting mechanism to shoot the ball at a distance configured to be catchable by an outstretched hand of the player.

20. The system of claim 16, wherein the ejection component juts out of the housing and wherein a remainder of the barrel is within the housing.

21. The system of claim 16, wherein the rotatable barrel is oriented at an angle to a side of the housing.

22. The system of claim 16, wherein the ball feeder is configured to receive balls that were collected on the field and urged into the ball pitching machine.

23. The system of claim 16, wherein the scooper is configured to direct collected balls to a bottom of the ball pitching machine and wherein the ball feeder is configured to receive balls from the bottom of the ball pitching machine.

24. The system of claim 16, wherein the ball pitching machine is situated adjacent one end of the track.

* * * * *